US009381623B1

(12) United States Patent
Yang et al.

(10) Patent No.: US 9,381,623 B1
(45) Date of Patent: Jul. 5, 2016

(54) OPEN WRENCH

(71) Applicants: Chun-Wei Yang, Taichung (TW); Zhe-Ping Zhang, Taichung (TW)

(72) Inventors: Chun-Wei Yang, Taichung (TW); Zhe-Ping Zhang, Taichung (TW)

(73) Assignee: ZHE JIANG YIYANG TOOL MANUFACTURE CO., LTD, Zhe Jiang (CN)

( * ) Notice: Subject to any disclaimer, the term of this patent is extended or adjusted under 35 U.S.C. 154(b) by 0 days.

(21) Appl. No.: 14/920,877

(22) Filed: Oct. 23, 2015

(51) Int. Cl.

| | |
|---|---|
| ***B25B 13/12*** | (2006.01) |
| ***B25B 13/46*** | (2006.01) |
| ***B25B 13/08*** | (2006.01) |
| ***B21K 5/16*** | (2006.01) |
| *B25B 13/56* | (2006.01) |
| *B25G 1/10* | (2006.01) |

(52) U.S. Cl.
CPC . *B25B 13/46* (2013.01); *B21K 5/16* (2013.01); *B25B 13/08* (2013.01); *B25B 13/56* (2013.01); *B25G 1/10* (2013.01)

(58) Field of Classification Search
CPC ..... B25B 13/46; B25B 13/08; B25B 13/56; B25B 23/00; B21K 5/16; B25G 1/10
USPC ..... 81/63.2, 58.2, 448, 454, 458, 90.3, 81/176.1, 176.15, 119, 125
See application file for complete search history.

(56) References Cited

U.S. PATENT DOCUMENTS

| | | | | |
|---|---|---|---|---|
| 3,709,073 | A * | 1/1973 | Kurtz | B25B 13/46 76/114 |
| 5,875,693 | A * | 3/1999 | Zurbuchen | B25B 13/461 81/177.1 |
| 6,227,079 | B1 * | 5/2001 | Liu | B25B 13/12 81/126 |
| 6,318,216 | B1 * | 11/2001 | Eggert | B25B 13/04 81/124.3 |
| D476,204 | S * | 6/2003 | Chang-Kao | D8/21 |
| 7,878,095 | B2 * | 2/2011 | Wu | B25B 13/08 81/179 |
| 8,056,446 | B1 * | 11/2011 | Wheeler | B25B 7/04 81/356 |
| 8,413,554 | B2 * | 4/2013 | Lee | B25B 13/08 81/179 |
| 8,534,167 | B2 * | 9/2013 | Liu | B25B 13/08 81/179 |
| 8,826,783 | B2 * | 9/2014 | Hu | B25B 13/08 81/179 |
| 2001/0020404 | A1 * | 9/2001 | Chang-Kao | B25B 13/12 81/127 |

* cited by examiner

*Primary Examiner* — Hadi Shakeri
*Assistant Examiner* — Danny Hong

(57) ABSTRACT

An open wrench includes two heads overlapped to each other, two covers connected to top and bottom of the heads, and a pawl. Each head has a first recess, a recessed section, a contact face, and a second recess. The pawl is movably located within the second recess. The pawl has a first engaging portion, a second engaging portion, a reception slot and a curved slot. A resilient member is located in the reception slot. A pin extends through the covers and the curved slot. The pin contacts one end of the resilient member and contacts one inner end of the curved slot. When an object is located in the first recess, the contact face contacts one side of the object, and the first and second engaging portions contact two adjacent sides of the object. The object can be rotated continuously.

13 Claims, 9 Drawing Sheets

OPEN WRENCH

BACKGROUND OF THE INVENTION

1. Fields of the Invention

The present invention relates to an open wrench, and more particularly, to an open wrench having a pawl clamped between two plate-like head piece to rotate the object.

2. Descriptions of Related Art

The conventional open wrench is disclosed in U.S. Publication No. 2013/0239758 and comprises an elongate body and a head is connected to the body. The head has two jaws and a mounting hole is defined between the two jaws. An opening is defined between two distal ends of the two jaws and communicates with the mounting hole. The axis of the mounting hole is perpendicular to the axis of the body. One of the jaws has a curved recess, a curved guide slot and a notch defined in the inside thereof. The curved recess, the curved guide slot and the notch open toward the direction of the axis of the mounting hole. The other jaw has a curved convex contact face protruding from the inside thereof. The curved guide slot has a first curved face defined in the inside thereof. The notch has a first side which has a first end connected with and is tangential to the end of the first curved face. The second end of the first side is bent to be a second side. The head is cut to have the two jaws with the mounting hole, the curved recess, the contact face, the opening, the curved guide slot and the notch by way of laser cutting or linear cutting. An engaging member is movably received in the curved guide slot and movable along the first curved face. The engaging member has at least one protrusion which is parallel with the axis of the mounting hole. The engaging member has two convex engaging portions. A recessed area is defined at the conjunction area between the two engaging portions. A resilient member is received in the curved guide slot and two ends of the resilient member bias the engaging member and the curved guide slot respectively. To covers are respectively welded to be connected with the head to cover up the engaging member. Each cover has a curved slot which shares a common axis with the first curved face. The at least one protrusion extends through the curved slot. The cover is cut to have the curved slot by way of laser cutting or linear cutting when a hexagonal head clamped in the mounting hole. The diameter of the first curved face is equal to or smaller than the shortest distance of two opposite sides of the hexagonal head. The contact face and a flat inside of the opening are in contact with one side of the hexagonal head. The two engaging portions respectively contact another two opposite sides of the hexagonal head. A corner of the hexagonal head is received in the recessed area between the two engaging portions. The longest distance between the curved recess and the contact face are larger than the distance between two diagonal corners of the hexagonal head. The first curved face is located on a circle and a center of the circle is located within the mounting hole. An angle from 35 to 50 degrees is defined between the shortest distance between the center and the axis of the hexagonal head and the side of the hexagonal head.

However, when the resilient member may disengage from the curved guide slot when the open wrench is returned and the engaging member is moved relative to the body of the wrench. Therefore, an extra piece is used to secure the resilient member in the curved guide slot. This makes the structure be more complicated and the manufacturing cost is increased. Besides, the body of the wrench has a certain thickness so that the pressing force is required to be increased, this increases the stress of the products. The covers are adhered to the body and may be peeled off after a period of time of use.

The present invention intends to provide an open wrench to eliminate the shortcomings mentioned above.

SUMMARY OF THE INVENTION

The present invention relates to an open wrench and comprises two heads overlapped to each other, two covers connected to top and bottom of the heads, and a pawl. Each head has a first recess, a recessed section, a contact face, and a second recess. The pawl is movably located within the second recess. The pawl has a first engaging portion, a second engaging portion, a reception slot and a curved slot. A resilient member is located in the reception slot. A pin extends through the covers and the curved slot. The pin contacts one end of the resilient member and contacts one inner end of the curved slot. When an object is located in the first recess, the contact face contacts one side of the object, and the first and second engaging portions contact two adjacent sides of the object.

The primary object of the present invention is to provide an open wrench which is easily to be manufactured and the object that is clamped by the open wrench can be rotated continuously.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
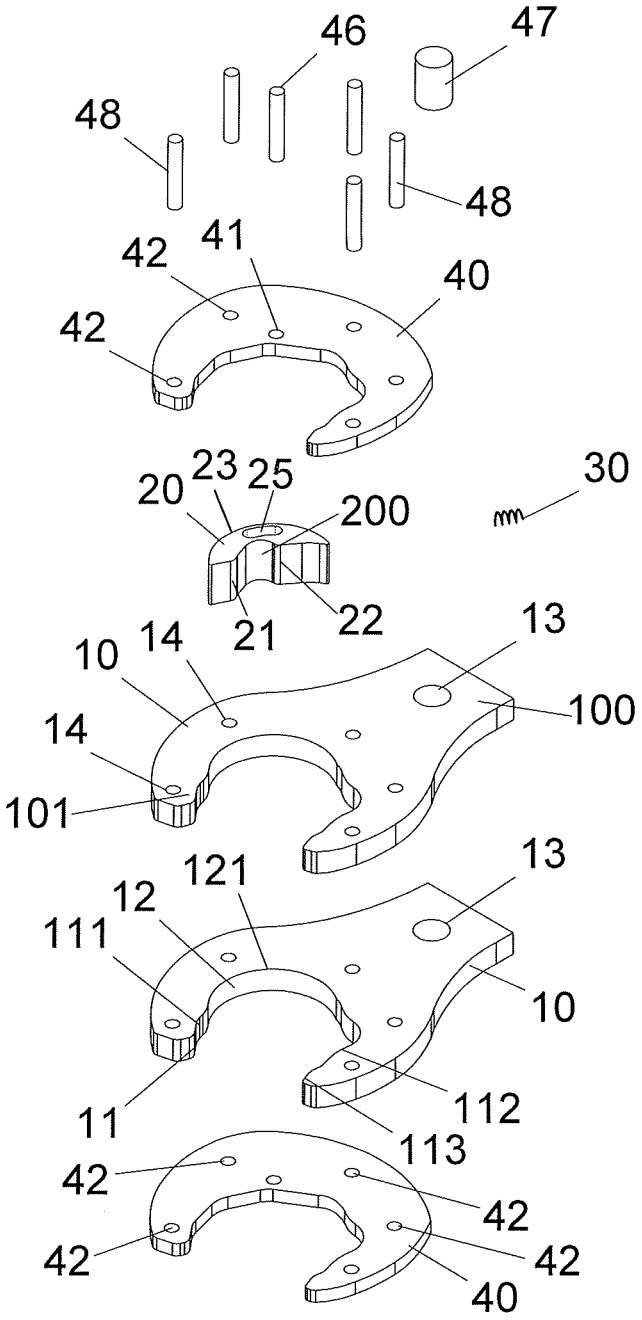
FIG. 1 is an exploded view of the open wrench of the present invention.
Figure 2:
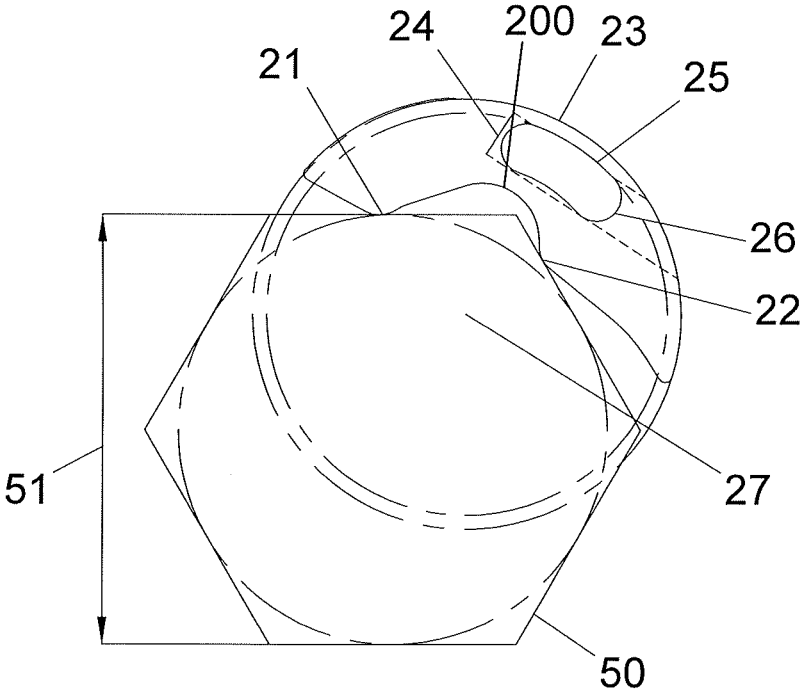
FIG. 2 is a top view of the pawl of the open wrench of the present invention.
Figure 3:
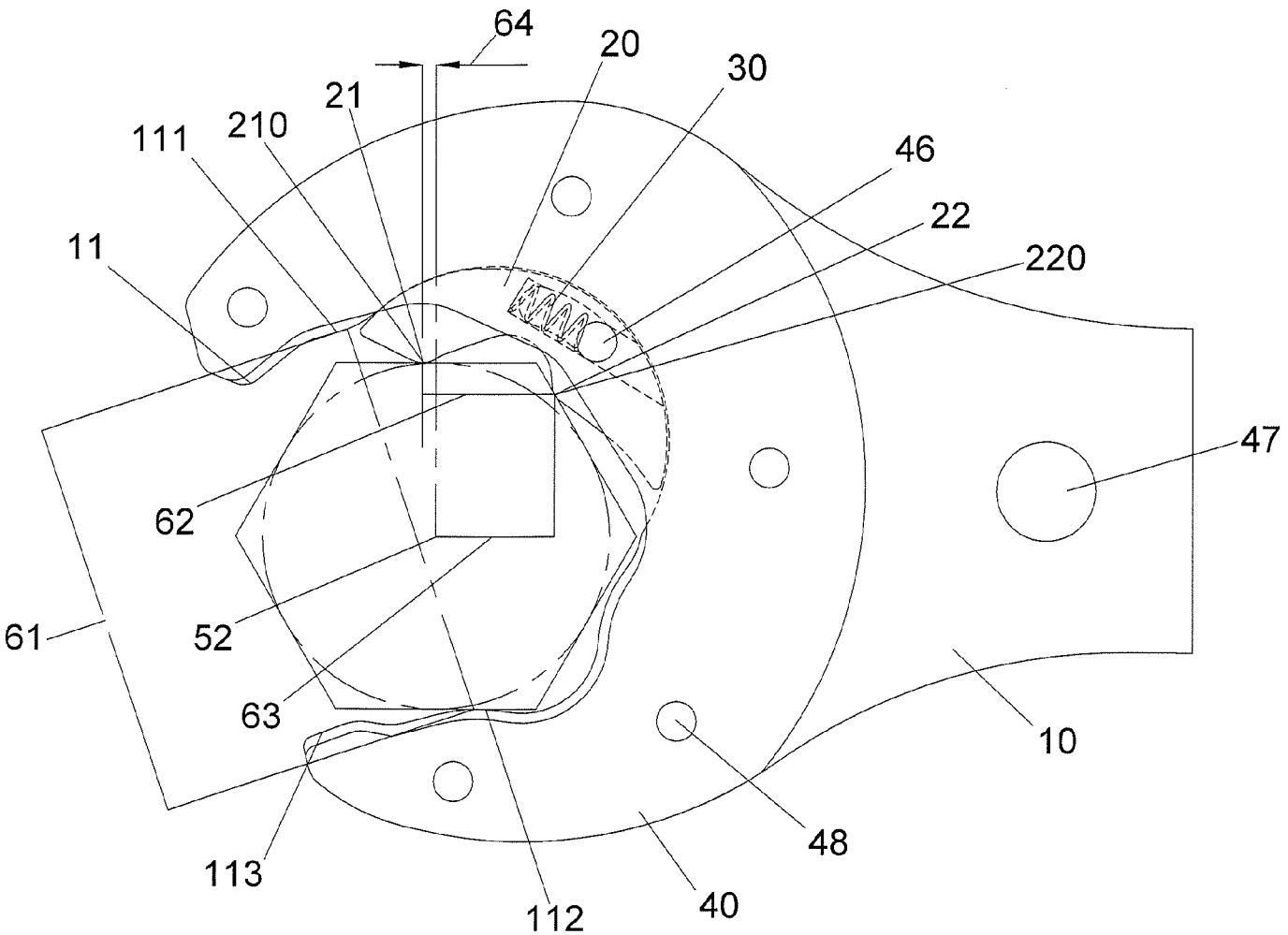
FIG. 3 is a top view of the open wrench of the present invention.
Figure 4:
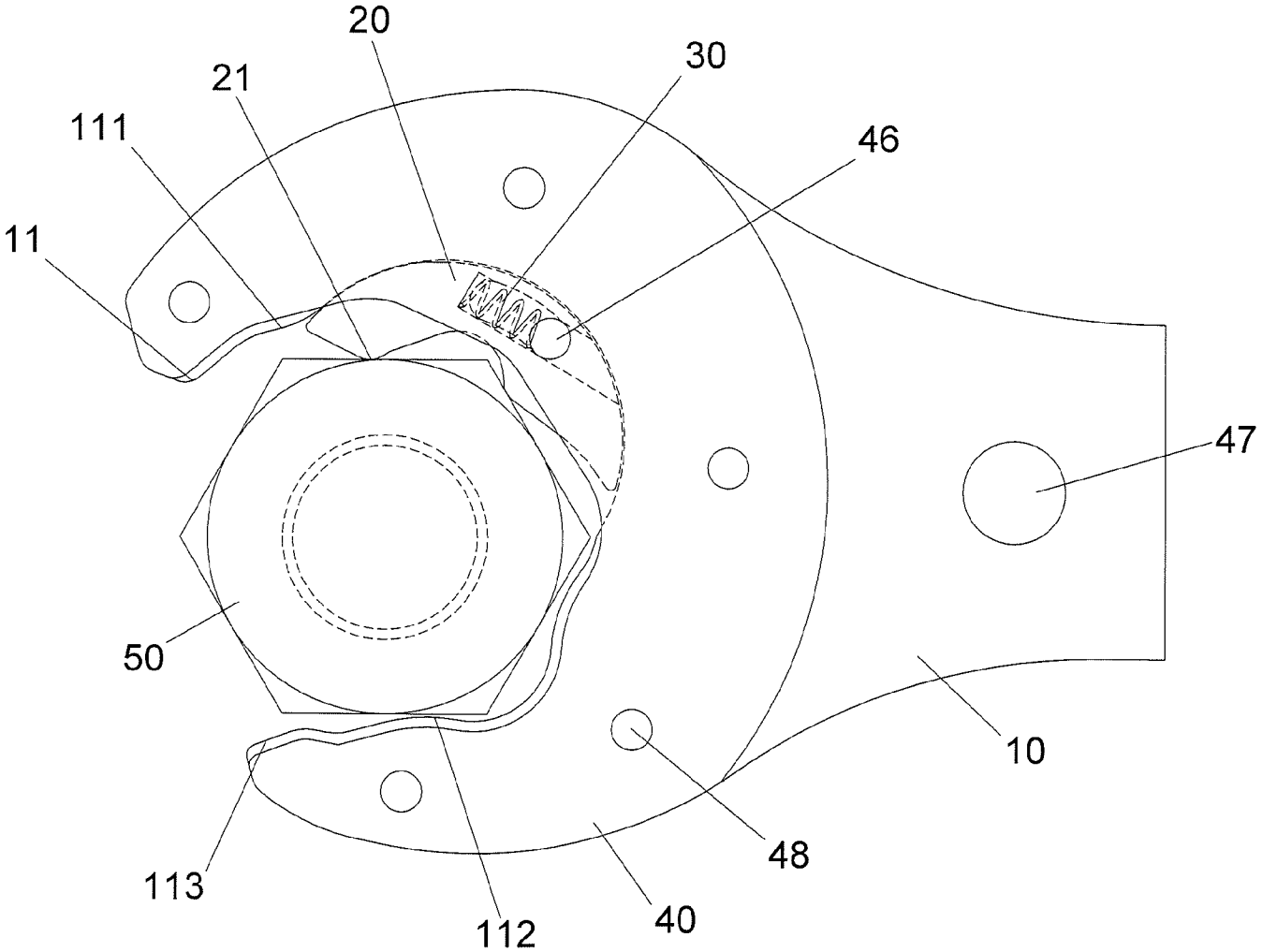
FIG. 4 shows that the open wrench of the present invention is rotated clockwise.

Referring to FIGS. 1 to 4, the open wrench of the present invention comprises an open wrench and comprises at least two identical heads 10, three or four heads 10 can also be used. Each head 10 has two jaws extending from the first end thereof, and a handle 100 extends from the second end of the head 10. A first recess 11 is defined between the two jaws. One of the two jaws has a recessed section 111 defined in the inside thereof, and the other one of the two jaws has a convex contact face 112 formed on the inside thereof. An inclined face 113 extends from the contact face 112 and toward the distal end of the jaw corresponding thereto. The inclined face 113 extends away from the axis of the handle 100. A second recess 12 is defined between the two jaws and has a first curved face 121.

The handle 100 has a first connection portion 13 which is a hole. Each head 10 has five second connection portions 14 which are holes as well.

A pawl 20 is movably located in the second recess 12 and has a recessed area 200 defined in the front side thereof, and a second curved face 23 defined in the rear end of the pawl 20. A first engaging portion 21 and a second engaging portion 22 respectively extend from two ends of the recessed area 200. The first and second engaging portions 21, 22 respectively protrude into the first recess 11. The second curved face 23 and the first curved face 121 have the same radius and are contact with each other. The pawl 20 has a reception slot 24 and a curved slot 25 which is defined through the top and the bottom of the pawl 20. The reception slot 24 communicates with the curved slot 25. The second curved face 23 and the curved slot 25 share a first center 27 which is located within the first recess 11. A resilient member 30 is located in the reception slot 24.

Two identical covers 40 are respectively connected to the top and the bottom of the two heads 10 overlapped to each other so as to seal the pawl 20 and the resilient member 30 to the two heads 10. Each cover 40 has a hole 41 which is located within the second recess 12 and located corresponding to the curved slot 25. Each cover 40 has five third connection portions 42 which are holes and located corresponding to the second connection portions 14.

A pin 46 extends through the holes 41 of the two covers 40 and the curved slot 25. The pin 46 contacts one end of the resilient member 30 and one of two inner ends of the curved slot 25. The pawl 20 is restricted by the pin 46 so that it does not drop from the second recess 12. When the pawl 20 moves along the first curved face 121, the pin 46 moves along the curved slot 25, so that the pawl 20 is guided by the curved slot 25.

A first connection member 47 extends the first connection portions 13 and connect the two heads 10 together. Five second connection members 48 extend through the second connection portions 14 and the third connection portions 42 to connect the two covers 40 to the two heads 10. The pin 46 and the five second connection members 48 have the same diameter.

When a hexagonal object 50 with six sides is located in the first recess 11, the diameter of the first curved face 121 is equal to or smaller than the width 51 of two facing sides of the object 50. The contact face 112 is tangent to one side of the object 50. The first and second engaging portions 21, 22 contact two adjacent sides of the object 50 at a first intersection point 210 and a second intersection point 220. The object 50 has three sides are in contact with the open wrench. The open wrench can rotate the object 50 clockwise.

The recessed area 200 receives one of six corners of the object 50. The maximum distance 61 between the recessed section 111 and the contact face 112 is longer than the maximum diagonal line of the object 50. The first and second intersection points 210, 220 are projected on the maximum diagonal line of the object 50 to form a first distance 62. A second distance 63 is defined from the point that the second intersection point 220 is projected on the maximum diagonal line of the object 50 to the axis 52 of the object 50. The first distance 62 is longer than the second distance 63. In one embodiment, the ratio of the difference between the first and second distances 62, 63 to the length of one side of the object 50 is within a range between 0.02 to 0.3. The pin 46 is force fitted with the holes 41 of the at least two covers 40, and the first connection member 47 is force fitted with the first connection portions 13 of the at least two heads 10. The second connection member 48 is force fitted with the third connection portion 42.

In another embodiment, the pin 46 has an end with outer threads, and the holes 41 of the two covers 40 each have inner threads. The pin 46 is threadedly connected to the holes 41 of the two covers 40. The first connection member 47 and the second connection members 48 each have one end thereof with outer threads. The first connection portions 13 and the second connection portions 14 of the two heads 10 each have inner threads. The first connection member 47 is threadedly connected to the first connection portions 13, and the second connection members 48 is threadedly connected to the second connection portions 14.

In yet another embodiment, the pin 46, the first connection member 47 and the second connection members 48 each are a rivet.

Figure 5:
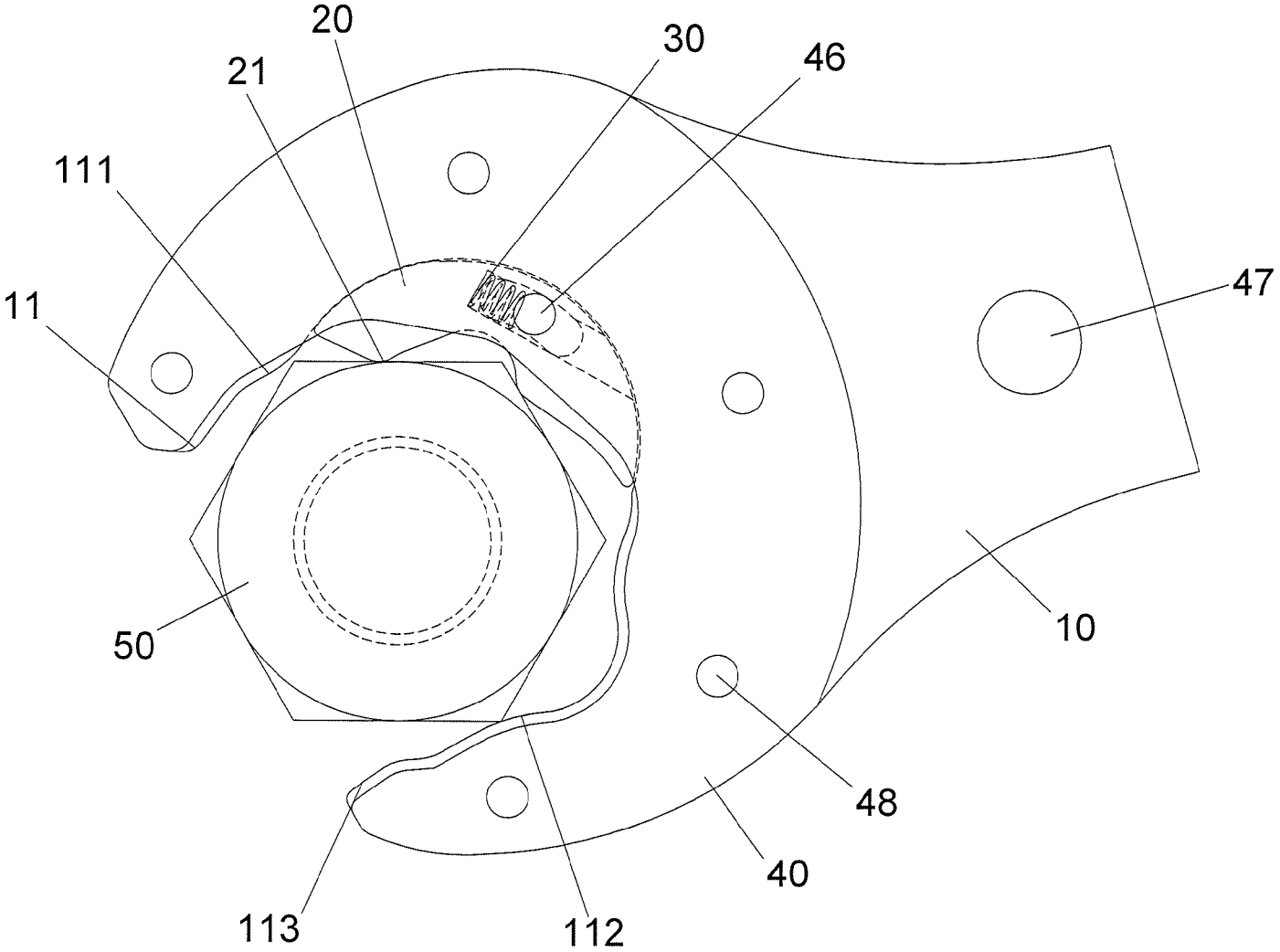
FIG. 5 shows that the open wrench of the present invention is rotated counter clockwise to a first position.
Figure 6:
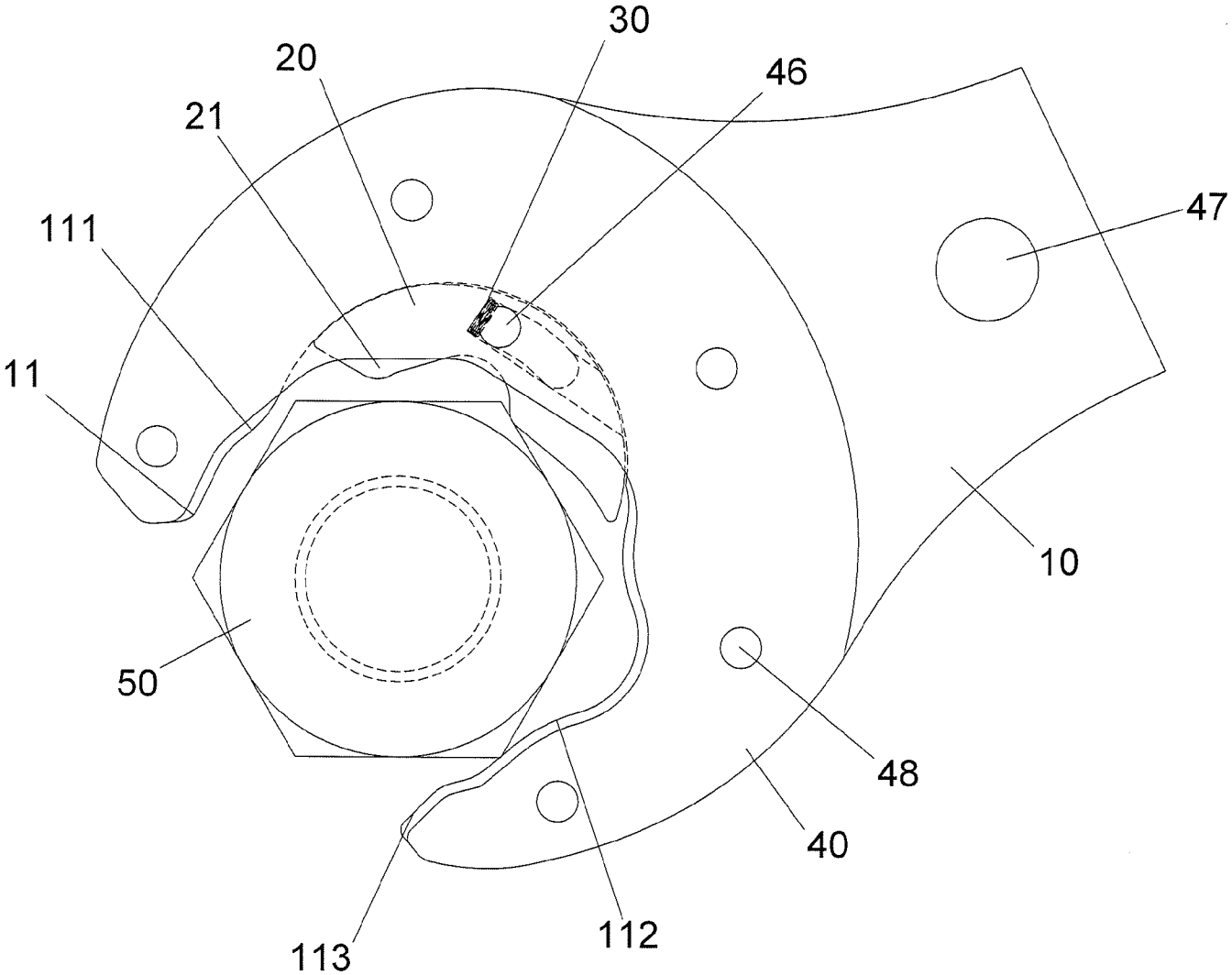
FIG. 6 shows that the open wrench of the present invention is rotated counter clockwise to a second position.
Figure 7:
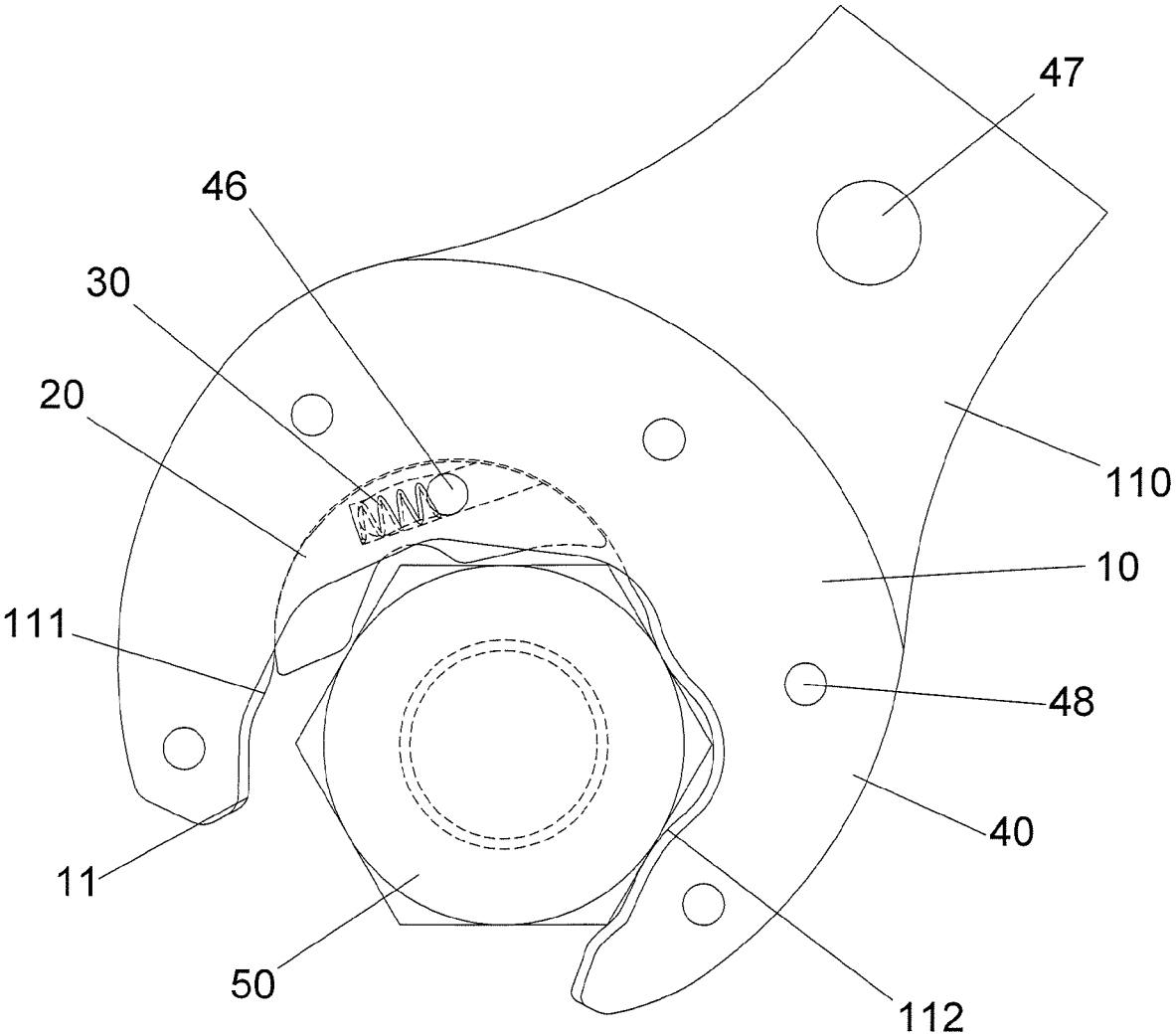
FIG. 7 shows that the open wrench of the present invention is rotated counter clockwise to a third position.

As shown in FIGS. 5 to 7, when the head 10 rotates the object 50 to an angle, the head 10 is rotated counter clockwise, because the maximum distance 61 is slightly longer than the maximum diagonal line of the object 50, so that the object 50 is rotated relative to the first recess 11 and the contact face 112 is separated from one side of the object 50. The pawl 20 is pushed by the object 50 to be moved into the second recess 12 along the curved slot 25. Therefore, the first and second engaging portions 21, 22 are separated from the two sides of the object 50. The resilient member 30 is compressed by the movement of the pawl 20 and contacts against the pin 46. When the head 10 is continuously rotated counter clockwise until the status as disclosed in FIG. 7, the head 10 is then able to mount the object 50 to rotate the object 50 clockwise again.

Figure 8:
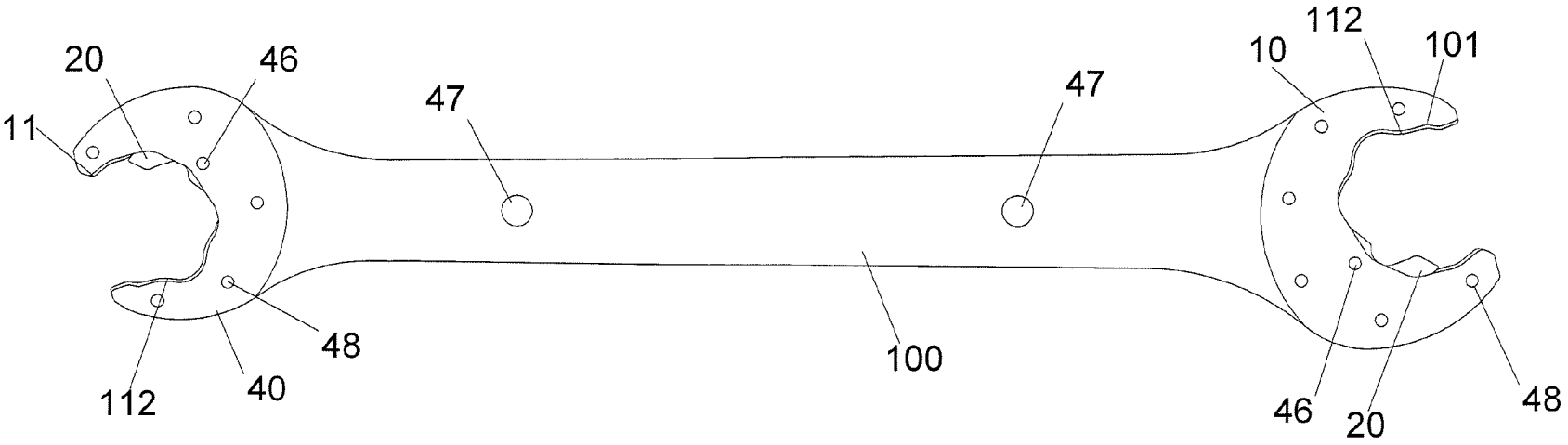
FIG. 8 shows the second embodiment of the open wrench of the present invention.
Figure 9:
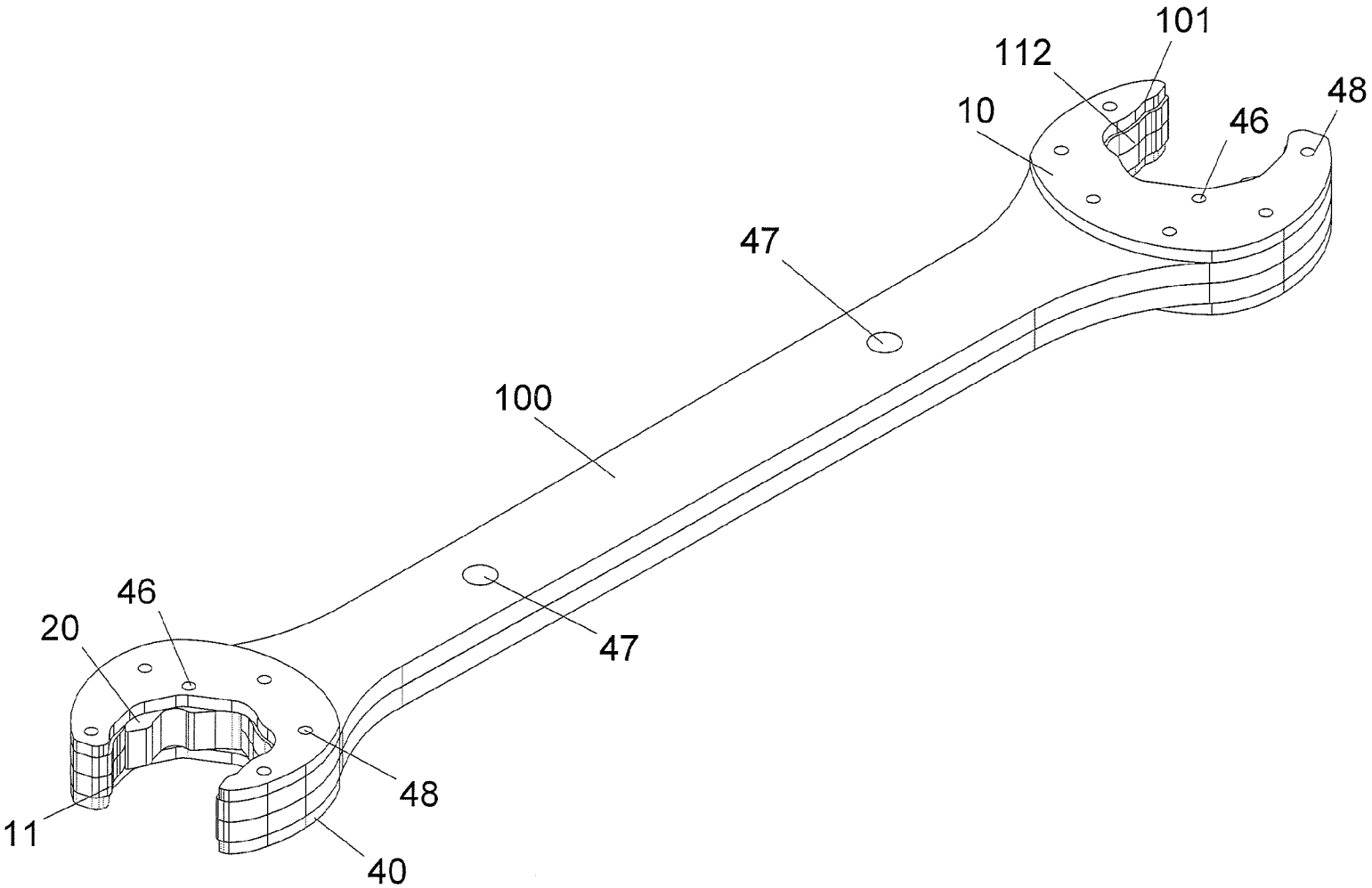
FIG. 9 is a perspective view to show the second embodiment of the open wrench of the present invention.

As shown in FIGS. 8 and 9, the handle 100 has an operation end 101 formed on each end of the handle 100.

It is noted that the two heads 10 and the two covers 40 are made by way of forging. The first recesses 11, the recessed sections 111, the contact faces 112, the inclined faces 113, the second recesses 12 and the first connection portions 13 are made by way of laser cutting or linear cutting. The two heads 10 and the two covers 40 can be also made by way of laser cutting or linear cutting from a single steel board. The two heads 10 and the two covers 40 are made by way of one-time pressing from a single board such as a steel board so as to reduce the manufacturing cost.

The advantages of the open wrench of the present invention are that the first distance 62 is longer than the second distance 63 so that the open wench can be easily operated and rotated.

There are three sides of the object 50 being in contact with the head 10 of the open wrench of the present invention so that the object 50 is easily rotated by the open wrench.

The resilient member 30 is located in the reception slot 24 of the pawl 20 and is restricted by the pin 46 so that the resilient member 30 is restricted within the reception slot 24 and does not drop off.

The pin 46 is guided by the curved slot 25 of the pawl 20, and the two covers 40 are connected to the top and the bottom of the head 10 to seal the curved slot 25, so that the outer appearance of the open wrench is improved.

The two heads 10 and the two covers 40 are made by way of one-time pressing from a single board such as a steel board so as to reduce the manufacturing cost.

While we have shown and described the embodiment in accordance with the present invention, it should be clear to those skilled in the art that further embodiments may be made without departing from the scope of the present invention.

What is claimed is:

1. An open wrench comprising:

at least two identical heads, each head having two jaws extending from a first end thereof and a handle extending from a second end of the head, a first recess defined between the two jaws, one of the two jaws having a recessed section defined in an inside thereof, the other one of the two jaws having a convex contact face formed on an inside thereof, an inclined face extending from the contact face and toward the distal end of the jaw corresponding thereto, the inclined face extending away from an axis of the handle, a second recess defined between the two jaws and having a first curved face, the handle having a first connection portion which is a hole, each head having multiple second connection portions which are holes;

a pawl movably located in the second recess and having a recessed area defined in a front side thereof, and a second curved face defined in a rear end of the pawl, a first engaging portion and a second engaging portion respectively extending from two ends of the recessed area, the first and second engaging portions respectively protruding into the first recess, the second curved face and the first curved face having the same radius and being in contact with each other, the pawl having a reception slot and a curved slot which is defined through a top and a bottom of the pawl, the reception slot communicating with the curved slot, the second curved face and the curved slot sharing a first center which is located within the first recess;

a resilient member located in the reception slot;

at least two identical covers respectively connected to a top and a bottom of the at least two heads overlapped to each other so as to seal the pawl and the resilient member to the at least two heads, each cover having a hole which is located within the second recess and located corresponding to the curved slot, each cover having multiple third connection portions which are holes and located corresponding to the second connection portions;

a pin extending through the holes of the at least two covers and the curved slot, the pin contacting one end of the resilient member and one of two inner ends of the curved slot, the pawl being restricted by the pin and being not dropping from the second recess, when the pawl moves along the first curved face, the pin moves along the curved slot;

a first connection member extending the first connection portions and connecting the at least two heads together;

multiple second connection members extending through the second connection portions and the third connection portions to connect the at least two covers to the at least two heads;

when an object with six sides is located in the first recess, a diameter of the first curved face is equal to or smaller than a width of two facing sides of the object, the contact face is tangent to one side of the object, the first and second engaging portions contact two adjacent sides of the object at a first intersection point and a second intersection point, the recessed area receives one of six corners of the object, a maximum distance between the recessed section and the contact face is longer than a maximum diagonal line of the object, the first and second intersection points are projected on the maximum diagonal line of the object to form a first distance, a second distance is defined from a point that the second intersection point is projected on the maximum diagonal line of the object to an axis of the object, the first distance is longer than the second distance.

2. The open wrench as claimed in claim 1, wherein a ratio of a difference between the first and second distances to a length of one side of the object is within a range between 0.02 to 0.3.

3. The open wrench as claimed in claim 1, wherein the pin is force fitted with the holes of the at least two covers.

4. The open wrench as claimed in claim 1, wherein the first connection member is force fitted with the first connection portions of the at least two heads.

5. The open wrench as claimed in claim 1, wherein the handle has an operation end.

6. The open wrench as claimed in claim 1, wherein the pin has an end with outer threads, the holes of the at least two covers each have inner threads, the pin is threadedly connected to the holes of the at least two covers.

7. The open wrench as claimed in claim 1, wherein the first connection member and the second connection members each have one end thereof with outer threads, the first connection portions and the second connection portions of the at least two heads each have inner threads, the first connection member is threadedly connected to the first connection portions, the second connection members is threadedly connected to the second connection portions.

8. The open wrench as claimed in claim 1, wherein the at least two heads and the at least two covers are made by way of forging, the first recesses, the recessed sections, the contact faces, the inclined faces, the second recesses and the first connection portions are made by way of laser cutting or linear cutting.

9. The open wrench as claimed in claim 1, wherein the at least two heads and the at least two covers are made by way of laser cutting or linear cutting from a single steel board.

10. The open wrench as claimed in claim 1, wherein the at least two heads and the at least two covers are made by way of one-time pressing from a single board.

11. The open wrench as claimed in claim 1, wherein the at least two heads includes three heads.

12. The open wrench as claimed in claim 1, wherein the at least two heads includes four heads.

13. The open wrench as claimed in claim 1, wherein the pin, the first connection member and the second connection members each are a rivet.

* * * * *